United States Patent [19]

Naruse et al.

[11] Patent Number: 4,854,130

[45] Date of Patent: Aug. 8, 1989

[54] REFRIGERATING APPARATUS

[75] Inventors: Nobutaka Naruse; Katsunobu Minari, both of Toyoake, Japan

[73] Assignee: Hoshizaki Electric Co., Ltd., Toyoake, Japan

[21] Appl. No.: 237,256

[22] Filed: Aug. 26, 1988

[30] Foreign Application Priority Data

Sep. 3, 1987 [JP] Japan ..... 62-219075
Sep. 3, 1987 [JP] Japan ..... 62-219076

[51] Int. Cl.[4] ..... F25C 5/10

[52] U.S. Cl. ..... 62/352; 62/278; 62/513

[58] Field of Search ..... 62/197, 196.4, 278, 62/352, 513

[56] References Cited

U.S. PATENT DOCUMENTS

| | | | |
|---|---|---|---|
| 2,385,667 | 9/1945 | Webber | 62/513 X |
| 2,770,104 | 11/1956 | Sweynor | 62/278 X |
| 2,961,848 | 11/1960 | Nonomague | 62/513 X |
| 3,020,726 | 2/1962 | MacLeod | 62/352 X |
| 3,201,950 | 8/1965 | Shrader | 62/197 |
| 3,214,929 | 11/1965 | Anderson | 62/197 X |
| 3,599,440 | 8/1971 | Melion | 62/278 X |
| 3,636,723 | 1/1972 | Kramer | 62/197 |
| 4,238,932 | 12/1980 | Schrader | 62/513 X |

*Primary Examiner*—William E. Tapolcai
*Attorney, Agent, or Firm*—Brooks Haidt Haffner & Delahunty

[57] ABSTRACT

A refrigerating apparatus comprises a compressor, a condenser, an expansion valve and a evaporator which are interconnected serially through a pipeline to form a closed circulation circuit. A check valve allowing a coolant flow only toward the condenser is provided between the discharge port of the compressor and the condenser. A hot gas bypass circuit is connected at one end to a junction between the compressor and the check valve and at the other end to a junction between the expansion valve and the evaporator. The check valve serves to prevent backflow of coolant to the hot gas bypass circuit during the hot gas operation mode without hindering the flow of the coolant gas through the closed circulation circuit during the normal refrigerating operation.

2 Claims, 2 Drawing Sheets

REFRIGERATING APPARATUS

BACKGROUND OF THE INVENTION

1. FIELD OF THE INVENTION

The present invention generally relates to a refrigerating apparatus and more particularly to a refrigerating apparatus provided with a hot gas bypass circuit for allowing a coolant gas of high temperature and high pressure to be selectively supplied to an evaporator constituting a part of the refrigerator.

2. PRIOR ART

Referring to FIG. 4 of the accompanying drawings, there is shown a typical conventional circuit arrangement of a refrigerating apparatus, wherein a gas coolant is compressed to a high temperature and a high pressure by a compressor 01 to be subsequently fed to a condenser 03 where the gas coolant is cooled by a fan 015 mounted externally. The coolant thus condensed is then expanded by an expansion valve 06 and subsequently evaporated by an evaporator 07 while absorbing external heat. The coolant leaving the evaporator 07 is circulated back to the compressor 01. In a practical application, the evaporator 07 may be employed as a cooler, for example, in an ice making machine. In that case, a hot gas (gas coolant) of a high temperature is supplied directly to the evaporator 07 by opening a hot gas bypass valve 011 during a defrosting or deicing operation mode of the ice making machine. In FIG. 4, reference numeral 09 designates an accumulator, and numeral 08 designates a check valve which serves to prevent the backflow of the coolant of high temperature and high pressure leaking from the compressor 01 to the evaporator 07.

In a refrigeration apparatus disclosed in Japanese Laid-Open Patent Application No. 73259/1985 (JP-A No. 60-73259), there is provided a gas circuit extending around a condenser and including a check valve similar to the check valve 08 shown in FIG. 4, although the hot gas bypass circuit of the type mentioned above is not incorporated. The gas circuit of this known refrigeration apparatus is designed to serve rapidly eliminating the pressure difference across the compressor upon stoppage thereof.

Turning back to FIG. 4, it is assumed that the refrigerating apparatus is used in combination with an ice making machine. When the operation of the compressor is stopped during an ice making operation due to an interruption of power supply, it is a common practice to restart the operation of the ice making machine from the hot gas bypass mode (i.e. deicing or defrosting cycle) in order to prevent twofold formation of ice and shortage of raw water. In this connection, it is noted that the attempt for restarting the ice making apparatus within the shortest possible time after restoration of power is accompanied with problems mentioned below. Upon interruption of power, the condenser will remain in a high temperature and high pressure state for a while. Accordingly, when the hot gas valve is opened to restart the operation of the ice making machine as soon as power is restored within a short time after the interruption, a large amount of coolant will then flow into the evaporator from the condenser together with the coolant gas discharged from the compressor. The large amount of gas coolant flowing into the evaporator is cooled to such extent that the gas-phase coolant and the liquid-phase coolant coexist in a mixed state. The gas and liquid mixture of the coolant will then flow into the accumulator. In that case, the liquid-phase coolant may often overflow from the accumulator into the compressor, causing damage to the latter. Further, if a rotary compressor is employed, the liquid-phase coolant flowing into the compressor will subsequently undergo compression, resulting in failure in the restarting operation.

Also, in order to realize a smooth restart of the compressor, the pressures of coolant in the discharge port and in the suction port of the compressor have to be balanced with each other at the earliest possible time. This requirement can not be satisfied with the structure of the refrigeration apparatus disclosed in JP-A No. 60-73259 mentioned above particularly when accumulators and compressors of large capacity are employed. In other words, a lot of time must be consumed for realizing the balance in pressure mentioned above. This can be explained mainly by the fact that the use of a large diameter pipe as well as employment of the accumulator involves a corresponding increase in the volume of the system as a whole, whereby increasing pressure in a low pressure region is accompanied with a remarkable time lag, while lowering of pressure in a high pressure region on the other hand is delayed because of a large amount of coolant existing in such region.

Furthermore, FIG. 5 shows a typical example of a prior art refrigerating circuit adopted in refrigerating devices, such as, for example, ice making machines in which the evaporator is employed for the freezing or icing operation.

In FIG. 5, a coolant of high temperature and high pressure discharged from a compressor 01 is cooled while flowing through a condenser 03 to be ultimately transformed into liquid of high pressure before being introduced into a receiver tank 05. The coolant flowing into the evaporator 07 through an expansion valve 06 is evaporated, absorbing external heat, as the result of which ice is formed on an ice making plate (not shown) disposed on the evaporator 07. The evaporated coolant gas is then circulated back to the compressor 01 through an accumulator 09. At that time, a part of the liquid coolant of high pressure and low temperature flows into the accumulator 09 through a liquid bypass circuit 030 to be mixed with the gas coolant, whereby the temperature of the latter is lowered. In this manner, the compressor 01 is maintained at a proper temperature.

In the defrosting or deicing process for removing the ice thus formed, a hot gas valve 011 is opened to supply a hot gas directly to the evaporator 07. When the hot gas valve 011 is opened to this end in the deicing process, the gas coolant of high pressure discharged from the compressor 01 flows into the evaporator 07 in an increased amount, being added with the coolant of high pressure from the condenser 03. The gas coolant is then cooled within the evaporator 07 due to the contact with the ice forming plate on which ice is formed. Thus, the coolant assumes a gas/liquid-mixed phase to be subsequently fed into the accumulator 09, as the result of which the liquid coolant level within the accumulator 09 is disturbed significantly. In such a situation, the accumulator can accommodate only a small amount of liquid coolant notwithstanding a relatively large capcity thereof. Consequently, a part of the liquid coolant may overflow into the compressor 01 to be compressed in the liquid state. This phenomenon is likely to incur damage to the compressor 01. In case the compressor 01 is of a rotary type, a so-called liquid backflow will take place to force out lubrication oil, which of course adversely affects the bearings or like parts.

SUMMARY OF THE INVENTION

Accordingly, it is a primary object of the present invention to provide a refrigerating apparatus in which a pressure-balanced state can be rapidly restored across a compressor upon restart after stoppage thereof while liquid backflow can be suppressed to a minimum.

With the above object in view, according to one aspect of the present invention, there is provided a refrigerating apparatus generallly comprising a compressor, a condenser, an expansion valve and a evaporator connected serially through a pipeline so as to form a closed coolant circulation circuit. The refrigerating apparatus includes a check valve provided between a discharge port of the compressor and the condenser to allow the coolant to flow only in the direction toward the condenser, and a hot gas bypass circuit provided so as to extend from a junction between the check valve and the discharge port of the compressor to the inlet port of the evaporator. The check valve disposed on the inlet side of the condenser prevents the backflow of coolant (inflow of coolant to the hot gas bypass circuit) from the condenser in the hot gas bypass operation, while presenting no obstacle to the flow of the gas coolant in the normal operation. Additionallly, upon stoppage of the compressor, the backflow of the coolant of high pressure to the compressor can be positively prevented, whereby the volume at the high pressure side apparently decreases to aid in lowering the pressure in the high pressure region through cooperation with the gas leakage occurring internally of the compressor.

According to another aspect of the present invention, there is provided a refrigerating apparatus including, in addition to the features mentioned above, the features that another check valve is interposed between the suction port of the compressor and the evaporator and that another bypass circuit is so provided as to extend around the expansion valve, the evaporator and the check valve. The bypass circuit extending around the expansion valve and the evaporator introduces the coolant of high pressure to the suction side of the compressor, to thereby promote rapid establishment of a pressure-balanced state upon restarting of the compressor after stoppage thereof for a short time.

According to a further aspect of the present invention, it is proposed that the refrigerating apparatus provided with the hot-gas bypass circuit for feeding the hot gas to a location between the evaporator and the expansion valve is further equipped not only with a check valve disposed on the inlet side of the condenser but also with a liquid bypass circuit which bypasses the evaporator and the expansion valve and bears a heat exchange relation to the hot gas bypass circuit.

The check valve disposed on the inlet side of the condenser allows the coolant of high temperature and high pressure to flow toward the condenser in the cooling operation while preventing the coolant of high pressure from flowing backwardly into the hot gas bypass circuit in the deicing or defrosting operation. Further, the hot gas flowing through the hot gas bypass circuit vaporizes the liquid coolant flowing through a capillary resistance tube incorporated in the liquid bypass circuit through heat exchange to thereby bring about a so-called vapor-lock state in which the flow resistance of the pipeline is increased to restrict the inflow of the coolant from the liquid bypass circuit.

BRIEF DESCRIPTION OF THE DRAWINGS

In the course of the following detailed description, reference will be made to the attached drawings in which.

DETAILED DESCRIPTION OF THE PREFERRED EMBODIMENTS

Figure 1:
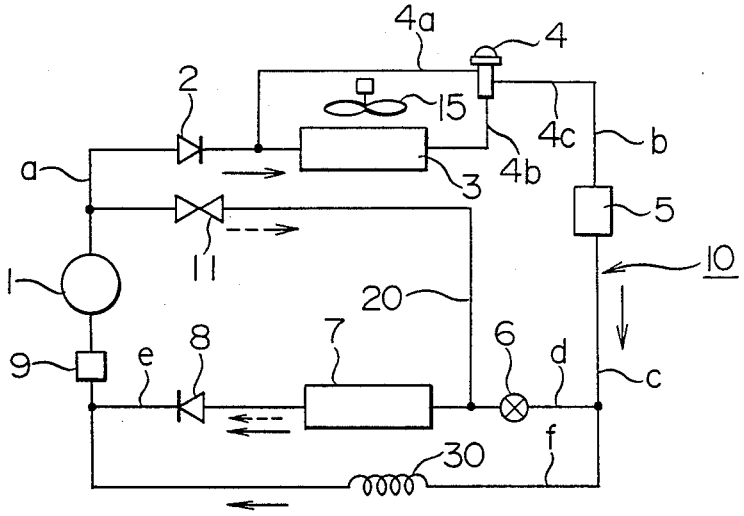
FIG. 1 is a schematic circuit diagram showing a structure of the refrigerating apparatus according to a first embodiment of the present invention.

Now, the present invention will be described in detail in conjunction with the preferred embodiments thereof by reference to the accompanying drawings, in which the same reference numerals denote the same or corresponding parts.

Referring to FIG. 1, a compressor 1, a check valve 2, a condenser 3, a condensation pressure regulating valve 4, a receiver tank 5, an expansion valve (expansion means) 6, an evaporator 7, a check valve 8 and an accumulator 9 are serially interconnected by means of pipes a to e in a well known manner as shown, to thereby constitute a closed primary coolant circulation circuit generally denoted by a reference numeral 10. Connected to the condensation pressure regulation valve 4 are a gas coolant conduit **4*a* extending to the coolant inlet side of the condenser 3 and a liquid coolant conduit 4*b* extending to the coolant outlet port of the condenser 3. Additionally, an outlet conduit 4*c* for the liquid coolant or gas/liquid mixture coolant extends from the regulating valve 4 to the receiver tank 5**.

A hot gas bypass circuit 20 including a hot gas valve 11 therein extends from a junction located between the discharge port of the compressor 1 and the inlet port of the check valve 2 to a junction located between the expansion valve 6 and the inlet port of the evaporator 7 to thereby allow the coolant to selectively bypass the pipes a, b, c and d. Further, a bypass pipe f extending from a junction between the outlet port of the receiver tank 5 and the inlet port of the expansion valve 6 and including a capilary tube 30 is connected to the inlet side of the accumulator 9, shunting the expansion valve 6, the evaporator 7 and the check valve 8.

In the normal cooling of refrigerating operation of the refrigerating apparatus having the arrangement described above, the compressed coolant discharged from the compressor 1 flows through the check valve 2, the condenser 3, the condensation pressure regulating valve 4, the receiver tank 5, the expansion valve 6, the evaporator 7, the check valve 8 and the accumulator 9 in this sequence to be returned to the compressor 1. Within the condenser 3, the coolant is cooled by a fan 15 mounted externally. Further, the coolant of low temperature and high pressure flows into the compressor 1 through the bypass pipe f to protect the compressor 1 against the temperature rise. The condensation pressure regulating valve 4 is of a conventional structure and well known to those skilled in the art. Accordingly, further description of this valve 4 will be unnecessary. It should however be mentioned that in the case where the refrigerating apparatus according to the instant embodiment is employed as a refrigerator in an ice making machine, the hot gas valve 11 is opened under command of a controller not show when the ice formation proceeds a predetermined extent, whereupon a deicing or defrosting operation is started. This start of the deicing operation brings about an increase in the rate of circulation of the coolant, while discharge pressure of the compressor 1 is instantaneously lowered. However, the backflow of the coolant from the condenser 3 is prevented by the check valve 2. Thus, only the coolant discharged from the compressor 1 can flow into the evaporator 7. During this operation, the coolant of high pressure also flows into the compressor 1 through the bypass pipe f, whereby a sufficient amount of circulation coolant can be assured. When the deicing operation proceeds to a certain extent, the hot gas valve 11 is closed under the command of the controller not shown, whereupon the normal cooling operation is restored.

When operation of the compressor 1 is stopped, the pressure prevailing in the suction port of the compressor 1 is increased due to the inflow of the coolant through the bypass pipe f and the gas leakage occurring internally of the compressor 1. To the contrary, the discharge pressure of the compressor 1 is lowered due to the gas leakage mentioned above. Thus, the differential pressure present across the compressor 1 upon stoppage thereof is rapidly nullified, resulting in that a balanced pressure state can be established across the compressor.

In the foregoing description, it has often been mentioned that the refrigerating apparatus according to the present invention is applied to an ice making machine. However, the invention is never restricted thereto but finds its application in various machines and systems in which the icing phenomenon takes place in association with the evaporator, thus requiring a defrosting operation.

Figure 2:
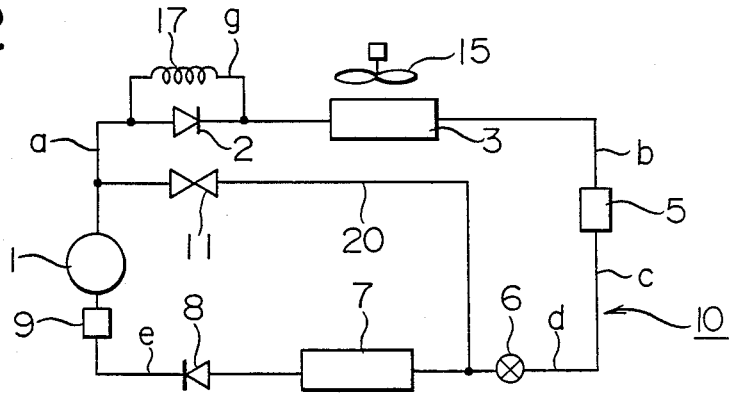
FIG. 2 is a schematic circuit diagram showing a structure of the refrigerating apparatus according to a second embodiment of the invention.
Figure 4:
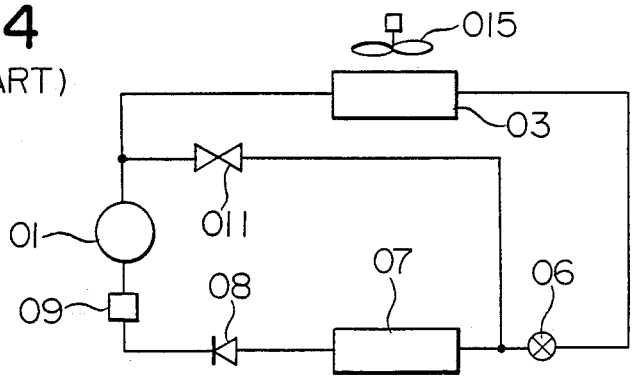
FIG. 4 (PRIOR ART)
FIG. 4 is a circuit diagram showing a typical example of the refrigerating circuits known heretofore.

FIG. 2 shows a refrigerating apparatus according to another embodiment of the present invention, wherein parts similar or corresponding to those shown in FIG. 1 are designated by the same reference numerals and detailed description thereof will be omitted. In FIG. 2, the check valve 2 is shunted by a bypass pipe g including a capillary tube 17 in order to suppress the backflow of the coolant which might otherwise take place when the hot gas bypass pipe 20 is activated.

Figure 3:
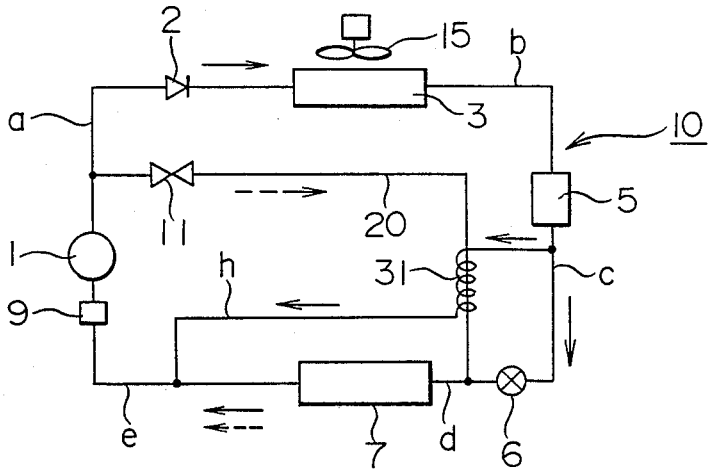
FIG. 3 is a schematic circuit diagram showing a structure of a third embodiment of the invention.
Figure 5:
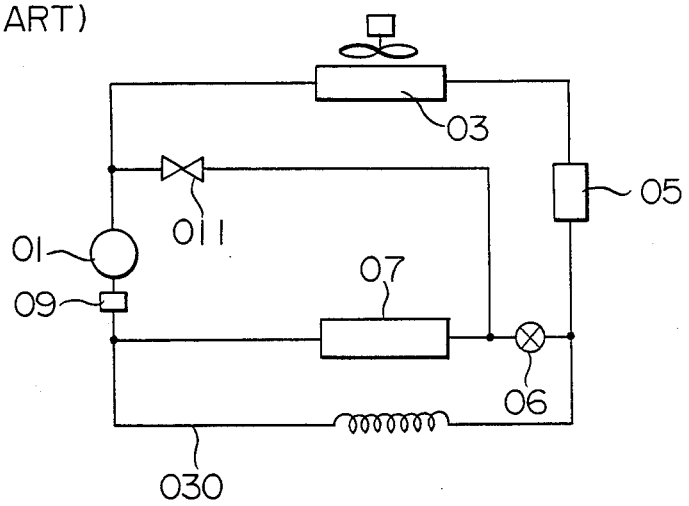
FIG. 5 (PRIOR ART)
FIG. 5 is a view similar to FIG. 4 and shows another typical example of the prior art refrigerating apparatus.

FIG. 3 shows still another embodiment of the invention, wherein parts similar or corresponding to those shown in FIGS. 1 and 2 are designated by the same numerals and detailed description thereof will be omitted. In FIG. 3, the pipes c and e are communicated with each other through a liquid bypass pipe h which includes a resistance tube 31 constituted by a capillary tube and disposed in heat exchange relationship with the hot gas bypass circuit 20. In a practical construction of the refrigerating apparatus, the pipes a to e are not necessarily implemented in the form of tubes but can be realized as passages or channels formed integrally in a casing or other member.

In the refrigerating apparatus of the arrangement described just above, the coolant flows through the primary circulation circuit 10 and repeatedly undergoes compression, condensation, expansion and evaporation during the cooling operation, as will readily be understood by those skilled in the art. A part of the high-pressure liquid coolant flows toward the outlet or exit side of the evaporator 7 through the resistance tube 31 and blows into the gas coolant flowing through the pipe e, whereby the temperature of the gas coolant is lowered to eventually prevent a temperature increase of the compressor 1. Needless to say, the hot gas valve 11 remains in the closed state in this operation mode.

When the ice formation has proceeded a desired extent under the action of the evaporator 7, the hot gas valve 11 is opened under the control of the controller (not shown) which per se is well known in the art. Consequently, the coolant flows into the hot gas bypass circuit 20, whereby the discharge pressure of the compressor 1 is instantaneously lowered due to an increase in the rate of circulation. However, the backflow of the coolant from the condenser 3 is prevented by the check valve 2. In other words, the amount of the coolant flowing into the evaporator 7 becomes substantially equal to that discharged from the compressor 1.

On the other hand, the high-pressure liquid coolant flowing through the resistance tube 31 of the liquid bypass circuit h disposed in the heat exchange relationship with the hot gas bypass circuit 20 is heated by the hot gas flowing therethrough. Consequently, the liquid coolant is evaporated to bring about a vapor-lock phenomenon, resulting in that the amount of coolant flowing through the liquid bypass circuit h is decreased.

When ice is completely removed (e.g. upon completion of deicing or defrosting operation in the ice making machine) as the result of the hot gas bypass operation mentioned above, the hot gas valve 11 is closed under the command of the control circuit mentioned above, whereupon the cooling operation is restored. Since the hot gas flow is interrupted, the vapor-lock phenomenon within the resistance tube will disappear in a short time.

By providing the check valve on the inlet port side of the condenser according to the teachings of the invention, it is possible to prevent the coolant from flowing backwards to the compressor from the condenser in the defrosting operation performed by making use of the hot gas bypass circuit, whereby inconveniences (breakdown, failure in starting operation and others) which might otherwise occur can be positively eliminated. Further, upon stoppage of operation of the compressor, the check valve is effective to apparently reduce the volume at the high-pressure side, whereby the pressure-balanced state can be established at the earliest possible time point after the stoppage of the compressor.

According to a preferred embodiment of the present invention, the bypass tube extending around the expansion valve and the evaporator can introduce an appropriate amount of the coolant to the suction side of the compressor from the high-pressure side, whereby establishment of the balanced pressure across the compressor at the earliest possible time can be further promoted.

Additionally, in a preferred mode for carrying out the invention, the inflow of the coolant from the liquid coolant bypass pipe is reduced due to the vapor-lock phenomenon. Thus, the return of the coolant to the accumulator in a proper amount can be assured, whereby backflow to the compressor is prevented.

Although at the end of the hot gas bypass operation, the compressor is in a cooled state, upon change-over to the cooling operation, inflow of the coolant from the liquid bypass pipe remains at a low level for a while, which means that the temperature of the compressor can rise at an increased rate. In particular, when the compressor is a rotary type, the compressor must be maintained at a higher temperature than the condenser. Otherwise, the coolant would dissolve in the oil within the compressor to undergo boiling or vaporization within the mass of oil depending on changes in pressure, temperature, etc., giving rise to a so-called foaming phenomenon in which bubbles are formed within the pool of oil to thereby raise the oil level within the compressor. However, such foaming phenomenon can be suppressed satisfactorily according to the teachings of the invention. It is further noted that in a reciprocating compressor, such phenomenon is likely to take place in which oil is sucked into the compressor through the suction port to undergo compression, which may eventually lead to damage of valves and other components. Such undesirable phenomenon can be prevented according to the invention. Further, in a rotary compressor, oil exists on the high pressure side, so consequently, oil is readily discharged through the discharge port of the compressor due to the blowing-out action of the gas coolant. This problem can also be solved by the present invention.

Upon stoppage of the compressor, the coolant located in the high pressure region is forcibly introduced to the suction port of the compressor, whereby balancing of pressure across the compressor can be established rapidly. Thus, the restarting characteristics of the compressor can be improved.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

What we claim is:

1. A refrigerating apparatus including a closed coolant circulation circuit in which a compressor, a condenser, an expansion valve and an evaporator, each having a coolant inlet port and a coolant outlet port, are serially interconnected in order of a flow of coolant during a refrigerating operation of said apparatus, comprising:

a check valve interposed between the outlet port of said compressor and the inlet port of said condenser;

a hot gas bypass circuit extending from a junction located between said check valve and the outlet port of said compressor to a junction located between the outlet port of said expansion valve and the inlet port of said evaporator; and a liquid bypass circuit extending from a junction between the outlet port of said condenser and the inlet port of said expansion valve to a junction between the outlet port of said evaporator and the inlet port of said compressor in heat exchange relationship with said hot gas bypass circuit.

2. A refrigerating apparatus according to claim 1, wherein said refrigerating apparatus constitutes a part of an ice making machine.

* * * * *